US008678707B1

(12) United States Patent
Powell et al.

(10) Patent No.: US 8,678,707 B1
(45) Date of Patent: Mar. 25, 2014

(54) WELL-HEAD BLOWOUT CONTAINMENT SYSTEM

(76) Inventors: John Powell, Santa Clarita, CA (US); Kenneth L. Green, Whittier, CA (US)

( * ) Notice: Subject to any disclaimer, the term of this patent is extended or adjusted under 35 U.S.C. 154(b) by 148 days.

(21) Appl. No.: 13/157,153

(22) Filed: Jun. 9, 2011

Related U.S. Application Data

(60) Provisional application No. 61/353,064, filed on Jun. 9, 2010.

(51) Int. Cl.

| | |
|---|---|
| ***E02B 15/04*** | (2006.01) |
| ***E02B 13/00*** | (2006.01) |
| ***E02B 15/00*** | (2006.01) |
| ***E02B 17/08*** | (2006.01) |
| ***E02D 29/00*** | (2006.01) |
| ***E02D 25/00*** | (2006.01) |
| ***E02D 23/02*** | (2006.01) |
| ***E02D 5/54*** | (2006.01) |
| ***E02D 5/74*** | (2006.01) |

(52) U.S. Cl.
USPC ..... 405/60; 405/52; 405/224; 405/203; 405/205; 405/210; 24/30.5 R; 383/71; 383/72; 383/73; 383/74; 383/75; 383/76

(58) Field of Classification Search
USPC ..... 405/51, 60, 203, 205, 210, 224; 383/71, 383/72, 73, 74, 75, 76; 24/30.5 R
See application file for complete search history.

(56) References Cited

U.S. PATENT DOCUMENTS

| | | | | | |
|---|---|---|---|---|---|
| 83,534 | A | * | 10/1868 | Nye | 383/25 |
| 182,771 | A | * | 10/1876 | Palmberg | 24/30.5 R |
| 254,440 | A | * | 2/1882 | Kutz | 383/75 |
| 294,228 | A | * | 2/1884 | Hanlon | 24/128 |
| 361,619 | A | * | 4/1887 | Cussen | 383/75 |
| 492,071 | A | * | 2/1893 | Vaughan | 383/71 |
| 527,558 | A | * | 10/1894 | Matthiesen et al. | 383/7 |
| 1,044,023 | A | * | 11/1912 | Colgate | 229/117.01 |
| 1,087,955 | A | * | 2/1914 | Knothe | 206/278 |
| 1,681,922 | A | * | 8/1928 | Boch | 383/39 |
| 1,941,871 | A | * | 1/1934 | Struve | 383/72 |
| 2,383,840 | A | * | 8/1945 | Benckert | 222/95 |
| 2,392,221 | A | * | 1/1946 | Brady | 383/76 |
| 3,289,415 | A | * | 12/1966 | Merrill | 405/61 |
| 3,339,512 | A | * | 9/1967 | Siegel | 114/257 |
| 3,429,128 | A | * | 2/1969 | Chamberlin et al. | 405/210 |
| 3,435,793 | A | * | 4/1969 | Shurtleff | 114/257 |
| 3,548,605 | A | * | 12/1970 | Armistead et al. | 405/60 |
| 3,561,220 | A | * | 2/1971 | Riester | 405/60 |
| 3,599,434 | A | * | 8/1971 | Missud | 405/60 |

(Continued)

FOREIGN PATENT DOCUMENTS

| | | | | | |
|---|---|---|---|---|---|
| WO | WO 8201387 | A1 | * | 4/1982 | E02B 15/04 |
| WO | WO 9311305 | A1 | * | 6/1993 | E02B 15/04 |
| WO | WO 9417251 | A1 | * | 8/1994 | E02B 15/04 |

*Primary Examiner* — John Kreck
*Assistant Examiner* — Edwin Toledo-Duran
(74) *Attorney, Agent, or Firm* — Kenneth L. Green

(57) ABSTRACT

An underwater oil well blowout spill containment system includes a folded curtain positioned in a magazine around a deep water well head and blowout preventer (BOP). The magazine is positioned around the well-head and BOP and leaves room for required construction and maintenance. In the event of a blowout, the curtain is drawn upward from the magazine and cinched to contain leaking oil. A hose is connected to a port on the magazine to draw the oil to a tanker on the surface.

18 Claims, 2 Drawing Sheets

(56) References Cited

U.S. PATENT DOCUMENTS

| | | | | | |
|---|---|---|---|---|---|
| 3,610,194 | A | * | 10/1971 | Siegel | 114/257 |
| 3,643,447 | A | * | 2/1972 | Pogonowski | 405/210 |
| 3,719,048 | A | * | 3/1973 | Arne et al. | 405/205 |
| 3,750,412 | A | * | 8/1973 | Fitch et al. | 405/217 |
| 3,788,079 | A | * | 1/1974 | Kirk et al. | 405/66 |
| 3,813,887 | A | * | 6/1974 | Kruger et al. | 405/188 |
| 3,851,487 | A | * | 12/1974 | Lambertsen | 405/185 |
| 3,879,951 | A | * | 4/1975 | Mason | 405/60 |
| 4,047,390 | A | * | 9/1977 | Boyce, II | 405/188 |
| 4,051,810 | A | * | 10/1977 | Breit | 119/51.04 |
| 4,231,873 | A | * | 11/1980 | Swigger | 210/170.05 |
| 4,290,714 | A | * | 9/1981 | Strange | 405/60 |
| 4,365,912 | A | * | 12/1982 | Burns | 405/60 |
| 4,373,834 | A | * | 2/1983 | Grace | 405/60 |
| 4,531,860 | A | * | 7/1985 | Barnett | 405/60 |
| 4,944,872 | A | * | 7/1990 | Kantor | 210/170.05 |
| 5,114,273 | A | * | 5/1992 | Anderson | 405/68 |
| 5,116,017 | A | * | 5/1992 | Granger et al. | 251/1.2 |
| 5,150,987 | A | * | 9/1992 | White et al. | 405/224 |
| 5,195,842 | A | * | 3/1993 | Sakow | 405/60 |
| 6,592,299 | B1 | * | 7/2003 | Becker | 405/210 |
| 6,739,274 | B2 | * | 5/2004 | Eagles et al. | 114/74 T |
| 7,258,710 | B2 | | 8/2007 | Caro et al. | |
| 7,399,411 | B2 | * | 7/2008 | DeAngelis | 210/242.4 |
| 2005/0025574 | A1 | * | 2/2005 | Lazes | 405/60 |
| 2005/0100414 | A1 | * | 5/2005 | Salama | 405/224.2 |
| 2011/0274496 | A1 | * | 11/2011 | Dvorak | 405/64 |

* cited by examiner

WELL-HEAD BLOWOUT CONTAINMENT SYSTEM

The present application claims the priority of U.S. Provisional Patent Application Ser. No. 61/353,064 filed Jun. 9, 2010, which application is incorporated in its entirety herein by reference.

BACKGROUND OF THE INVENTION

The present invention relates to deep water oil well leak containment and in particular to a well-head curtain for capturing escaping oil from a deep water well-head leak.

Known devices to prevent uncontrolled release of oil into the ocean from underwater well blowouts fall into two categories: a) conical or umbrella-like structures that are lowered from a surface vessel over the blowout, and b) conical or dome-like structures that are permanently installed over the well-head and that have some means of withdrawing collected oil and gas. These approaches all have many disadvantages, evidenced by the fact that none of them are in use. Among the more serious drawbacks are difficult if not impossible positioning of a conical or other structure over the venting oil and gas plume, failure to contain all or most of the oil, awkward deployment means which often requires specialized support equipment or vessels, obstruction of the well-head, interference with normal drilling operations, the requirement that the containment apparatus be prepositioned in a convenient location on land near the drill site or on the drilling platform, a long time delay between well blowout and spill containment, and the need for special training, apparatus, vessels, or crews for placement and or operation.

BRIEF SUMMARY OF THE INVENTION

The present invention addresses the above and other needs by providing an underwater oil well blowout spill containment system which includes a folded curtain positioned in a magazine around a deep water well head and BlowOut Preventer (BOP). The magazine is positioned around the well-head and BOP and leaves room for drilling operations, required construction, and maintenance. In the event of a blowout, the curtain is drawn upward from the magazine and cinched to contain leaking oil. A hose is connected to a port on the magazine to draw the oil to a tanker or barge on the surface.

In accordance with one aspect of the invention, there is provided an underwater oil well blowout spill containment system that is anchored at the seabed free of the turbulent oil and gas plume, and that is pulled up around the plume and therefore does not have to work against the buoyancy forces of that plume as do existing devices that require the positioning and placement of a containment device over an erupting oil and gas plume.

In accordance with another aspect of the invention, there is provided an underwater oil well blowout spill containment system that is situated at the well-head in advance, and therefore does not require locating the well-head from the surface or with a submersible vessel, and does not require mechanisms and procedures for guiding the containment device into position over the well-head.

In accordance with yet another aspect of the invention, there is provided an underwater oil well blowout spill containment system which is stowed in an annular magazine. The annular magazine has a maximum height substantially less than the height of the blowout preventer and that has an inner diameter substantially greater than the furthest extent of any part of the blowout preventer, thereby allowing unfettered access to the well-head and blowout preventer.

In accordance with yet another aspect of the invention, there is provided an underwater oil well blowout spill containment system which is sufficiently well anchored and of low enough profile as to not be displaced by currents or other disturbances.

In accordance with yet another aspect of the invention, there is provided an underwater oil well blowout spill containment system which is deployed by the same apparatus and with the same procedures used to deploy the blowout preventer.

The present invention eliminates all of the above issues and more. It is relatively inexpensive, it is always available and in place, it does not interfere in any way with normal drilling operations, it will capture all of the oil and gas emitted by the blowout, it does not require special or unique sea surface apparatus or vessels, it does not have any operational requirements that are different than those with which drilling crews are familiar, and if it needs to be activated, the required actions are the same as those normally used for drilling and well completion.

This invention is a device which is intended to be put in place at the well-head of every undersea drilling site before drilling begins or on existing well sites. If a blowout or significant leak occurs, the means to capture the leaking oil will already be in place at the needed location. The only action required will be to connect the loose ends of pre-connected cables to take-up reels aboard a vessel or the drill rig, and to connect a relief tube to the valve or fitting already located on the device and through which the oil and gas can be directed to a surface vessel. All of these operations are commonplace and routine activities for anyone versed in the art of undersea drilling.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 2:
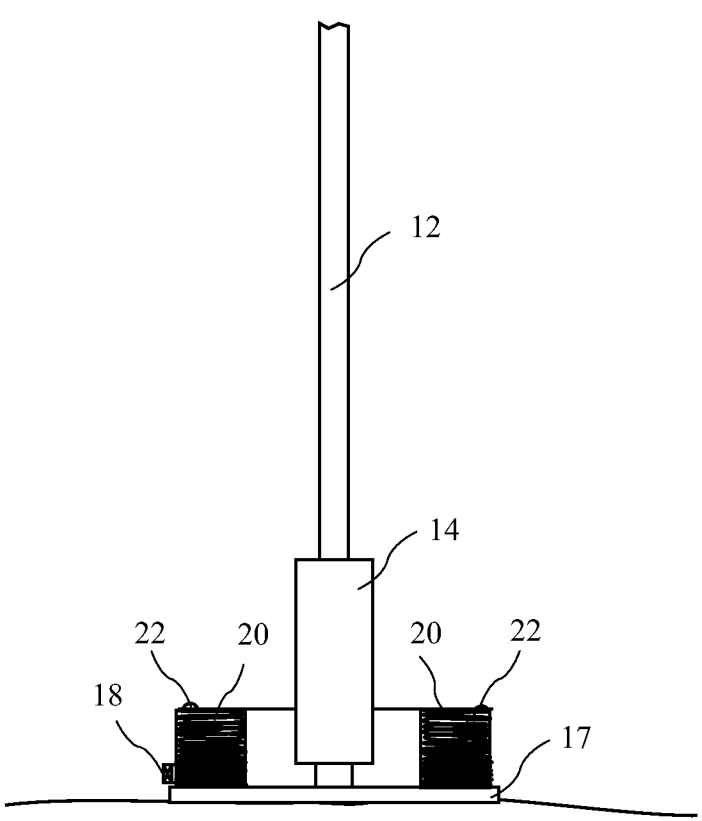
FIG. 2 is a cross-sectional view of the underwater oil well blowout spill containment system according to the present invention positioned around the BOP for future use.
Figure 1:
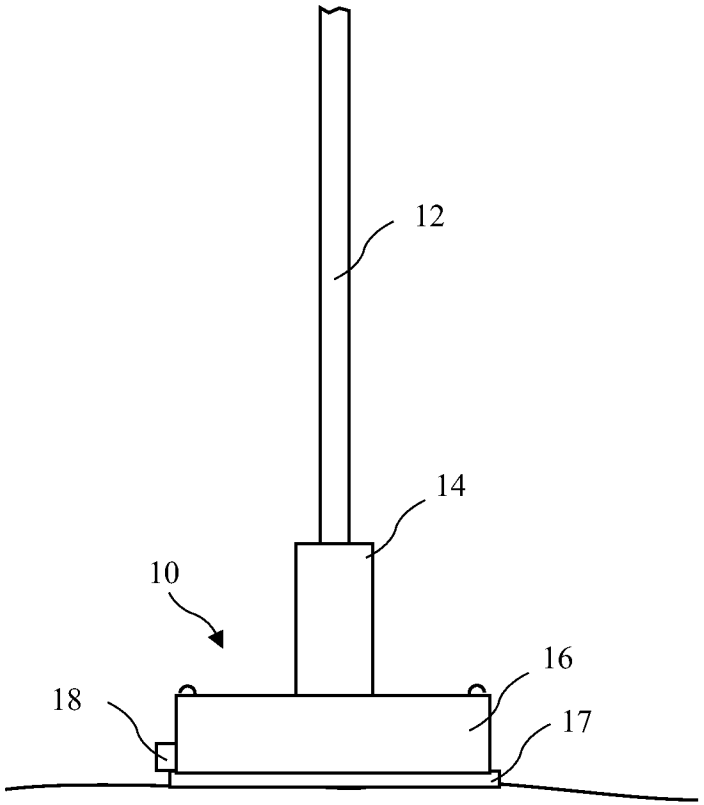
FIG. 1 is a side view of a deep water well head with an underwater oil well blowout spill containment system according to the present invention positioned around a BlowOut Preventer (BOP) for future use.
Figure 1B:
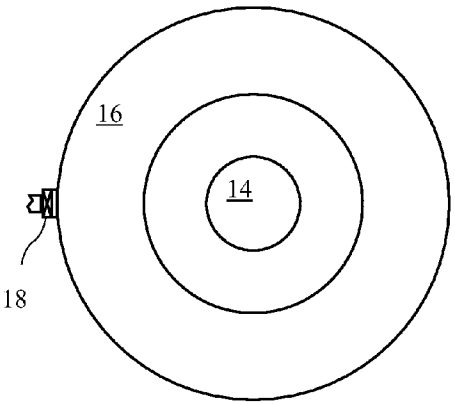
FIG. 1B shows a top view of the deep water well head with an underwater oil well blowout spill containment system according to the present invention positioned around a BOP for future use.

The world wide need for energy has driven pushed oil exploration and drilling into very deep water regions. Leaks or blowouts at any depth and especially at deep locations can be very difficult to deal with. The invention is a well-head blowout containment system for addressing these leaks. A side view of a deep water well head with the well-head blowout containment system 10 according to the present invention is shown in FIG. 1 positioned around a BlowOut Preventer (BOP) 14 for future use, and a top view of the well-head blowout containment system 10 forming a closed circle around the BOP 14 is shown in FIG. 1B positioned around a BlowOut Preventer (BOP) 14 for future use. A cross-sectional view of the well-head blowout containment system 10 according to the present invention is shown in FIG. 2 positioned around the BOP 14. The well-head blowout containment system 10 includes a flexible curtain 22 which is stowed collapsed or furled inside a magazine 16 encircling the well-head and BOP 14. The vertical dimension of the magazine 16 is much less than that of the BOP 14 and the inside diameter of the magazine is sufficiently larger that the BOP 14, so that the magazine 16 does not interfere in any way with work on the BOP 16, for example, normal drilling and completion operations or BOP 14 activation. A valve/coupling 18 is attached to the magazine 16 to allow connecting a hose 28 (see FIG. 3) for carrying oil collected by the well-head blowout containment system 10 to a tanker or barge on the surface.

The magazine 16 is preferably made of a strong material, for example steel or stainless steel, to avoid damage during work on the BOP 14 and/or well-head. The magazine 16 is preferably held on the sea bed with a heavy base anchor ring 17 around the base of the magazine 16.

Figure 3:
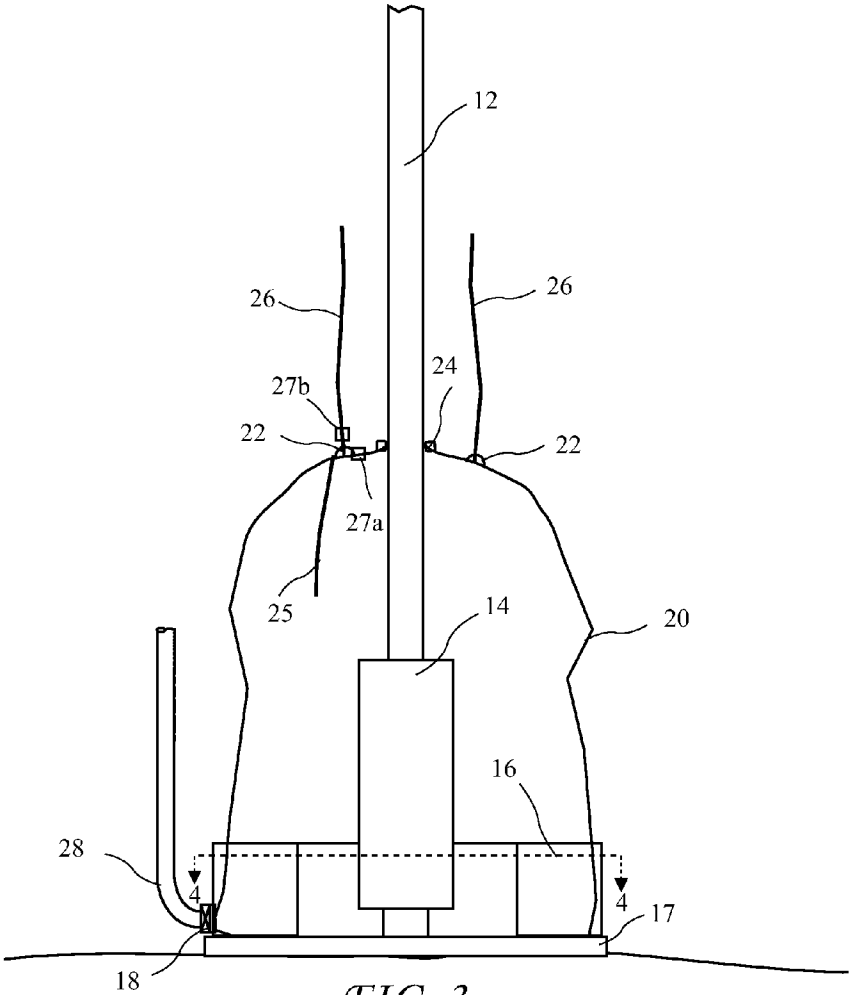
FIG. 3 is a cross-sectional view of the underwater oil well blowout spill containment system according to the present invention deployed to capture leaking oil.

A cross-sectional view of the underwater oil well blowout spill containment system 10 deployed to capture leaking oil is shown in FIG. 3. The hose 28 is connected to the valve/coupling 18 which terminates on the inside of the curtain 22 and is affixed to the outer diameter of the magazine 16. The curtain 20 is deployed by lifting lugs 22 attached to an upper edge of the curtain 20. The lifting lugs 22 may be attached to cables 26 previously connected at several locations around the upper edge of the curtain 20. If a blowout occurs, the cables 26 are drawn upward by take-up reels on a surface vessel or platform and the curtain 20 is lifted vertically by this action to a height above the top of the BOP 14 and cinched around the drill pipe 12. Such cinching may be performed in several manners. For example, a cinching apparatus may comprise a cable mechanism within the curtain 20 may release a first latch 27*a* on a cinching belt 24. At this point, further cable 26 take-up causes the upper edge of the curtain 20 to be drawn closed around the drill pipe 12 like a common trash bag. As the belt 24 tightens around the drill pipe 12 a predetermined tension is reached in the cinching belt (not shown, but similar to a trash bag string or belt), and a second latch triggers a cable release. The well-head and BOP 14 are now completely enclosed by the curtain 20, and the escaping oil and gas can be withdrawn through the hose 28 and collected in a barge or vessel on the sea surface.

An alternative means of lifting the curtain are buoyant members attached to the top edge of the curtain 20. The buoyant members may include a compressed gas which is released into the buoyant members to lift the curtain 14, or a material combusted to fill the buoyant members (e.g., as in the instance of automotive air bags.)

While a single valve 18 in the magazine 16 is preferred, additional valves 18 may be spaced around the magazine providing alternate hose connections, or additional valves may be added to the curtain 20 near the upper end of the curtain 20. A strainer may also be places over the inlet (curtain side) of the valve 18.

The underwater oil well blowout spill containment system 10 is intended to be put in place as one of the first steps in the drilling process. It will provide an ultimate backup solution capable of containing leaking oil and gas in the event other preventative measures fail, namely the BOP 14, as in Mexico's Ixtoc 1 blowout in 1979 and the 2010 BP incident in the Gulf of Mexico, among many other blowouts worldwide. The underwater oil well blowout spill containment system 10 will also fulfill this function in the event of a casing or seal blowout, fracture, or other leak-causing failure below the BOP 14.

The underwater oil well blowout spill containment system 10 may be deployed easily during initial preparations for drilling, would not interfere with normal drilling operations, is relatively inexpensive insurance against a costly spill, and needs no attention at all unless it is needed, and at that time no unfamiliar activities are required on the part of the drilling crew for deployment. Such a blowout containment system will provide genuine and complete containment, and it will ease the concerns of regulatory agencies and the public over underwater and particularly deepwater drilling.

The curtain 20 may be a cylindrical bag forming a vertical curtain wall, or have a conical or dome-like shape. The curtain 20 is preferably made from a resilient material, for example, Kevlar coated with polytetrafluoroethylene (PTFE) or fluorinated ethylene propylene (varieties of Teflon). The curtain 20 may be fabricated from material similar to the marine exhaust capture bonnet used with the system disclosed in U.S. Pat. No. 7,258,710, the curtain 20 made from a similar material of suitable strength, corrosion resistance, abrasion resistance, and flexibility to function for long periods in the undersea environment. Other materials such as a coated ballistic nylon or one of the engineering plastics could also be considered for use.

To deploy the curtain 20 in the event of a blowout and the failure of other containment means, cable 26 attached to unfurling/cinching lugs 22 on the top of the stowed curtain wall may be taken in either from the drilling platform/drill rig, or in the event that the surface platform is destroyed, by auxiliary surface or underwater vessels. At the same time the curtain deployment is begun the suction hose 28 from a surface vessel would be connected to the valve or fitting 18 on the side of the fixed magazine 16 and the valve 18 opened. The cables 26 would then be taken in to draw the curtain 20 up above the top of the BOP 14. When a preset vertical height is reached, a trip cable 25 may release the belt 24 while at the same time preventing further vertical travel of the curtain 20, and further cable 26 take-up would clinch the top edge of the curtain 20 around the drill pipe 12 if one is still present, otherwise the curtain 20 would be closed tight on itself like a trash bag. When the curtain 20 is fully closed a second latch 27*b* would release the take-up cables 26, leaving the curtain 20 completely enclosing the well-head, the BOP 14, and any other well-head apparatus.

The underwater oil well blowout spill containment system 10 locates no moving mechanisms other than the valve 18 and passive deployment latches underwater, thus providing a reliable solution to undersea well-head leaks.

While the invention herein disclosed has been described by means of specific embodiments and applications thereof, numerous modifications and variations could be made thereto by those skilled in the art without departing from the scope of the invention set forth in the claims.

We claim:

1. A capture system for oil escaping from a deep water well-head, the capture system comprising:

an annular magazine residing on a sea bed circling a well-head;

a collapsed curtain residing in the annular magazine and forming a closed circle around the well-head and a blow-out preventer;

cables attached proximal to an upper edge of the curtain for lifting the curtain out of the annular magazine vertically;

a cinching belt proximal to the upper edge of the curtain for cinching the upper edge of the curtain either around a drill pipe if present, or to close the upper edge of the curtain, after the upper edge of the curtain is lifted above the blowout preventer; and a fitting through the curtain, the fitting connectable to a hose reaching to an ocean surface to carry oil captured by the curtain to a container residing on the surface.

2. The capture system of claim 1, wherein the capture system permanently resides on the sea bed, and prepared to deploy the curtain to capture leaking oil, and leaving an area above and near the well-head free of obstructions.

3. The capture system of claim 1, wherein the curtain remains collapsed within the annular magazine until deployed to contain leaking oil and gas.

4. The capture system of claim 3, wherein the annular magazine is of low enough height and sufficient inside diameter to avoid interference with normal drilling operations.

5. The capture system of claim 3, wherein the curtain is furled or folded in the annular magazine prior to deployment and the curtain remains in the annular magazine, out of the way, unless needed for spill containment.

6. The capture system of claim 3, wherein the base of the annular magazine is weighted to resist or prevent movement of the annular magazine.

7. The capture system of claim 6, wherein the annular magazine is weighted by a heavy ring which further serves as an anchor to keep the annular magazine securely in place.

8. The capture system of claim 3, wherein the annular magazine includes a magazine outer cylindrical wall containing a fitting for connection to the hose through which all the entrapped oil and gas can be withdrawn to a surface vessel.

9. The capture system of claim 8, wherein the fitting is configured to be operated by apparatus selected from the group consisting of a remotely operated underwater vehicle, and a line or cable connected to a surface vessel for removal of oil and gas.

10. The capture system of claim 3, wherein the annular magazine includes sides made from metal of sufficient thickness that incidental contact with the drill pipe or other drilling apparatus will not compromise the functioning of the capture system.

11. The capture system of claim 1, wherein the curtain is made of a material which will withstand considerable a pressure gradient without rupture.

12. The capture system of claim 11, wherein the curtain is made of material selected from the group consisting of Kevlar coated with polytetrafluoroethylene (PTFE) or fluorinated ethylene propylene, ballistic nylon coated with a plastic such as PFE, and from one of the engineering plastics.

13. The capture system of claim 1, wherein three or more lifting and cinching lugs are attachable to the upper edge of the collapsed curtain for the purpose of attaching the cables when the capture system is needed to contain leaking oil and gas, the lifting and cinching lugs allow the collapsed curtain to be pulled vertically up and around the blowout preventer by the lines or cables attached to a surface vessel or underwater vehicle.

14. The capture system of claim 1, wherein the curtain is lifted by buoyant elements attached to the upper edge of the curtain.

15. The capture system of claim 1, wherein the preset height is a height above the blowout preventer.

16. The capture system of claim 1, wherein when a preset force is exerted on the cinching belt, a second latch is tripped, which both locks the cinching belt, and frees the cables to prevent any further lifting or cinching of the curtain.

17. A capture system for oil escaping from a deep water well-head, the capture system comprising:

a collapsed curtain residing in an annular magazine around a well-head and blowout preventer;

cables attached proximal to an upper edge of the curtain for lifting the curtain vertically;

a cinching belt proximal to the upper edge of the curtain for cinching the upper edge of the curtain either around a drill pipe if present, or to close the upper edge of the curtain, the cinching belt released to cinch the upper edge of the curtain after the upper edge of the curtain is lifted above the blowout preventer; and a fitting through the curtain, the fitting connectable to a hose reaching to an ocean surface to carry oil captured by the curtain to a container residing on the surface.

18. A capture system for oil escaping from a deep water well-head, the capture system comprising:

a collapsed curtain residing in a closed circle around a well-head and blowout preventer;

cables attached proximal to an upper edge of the curtain for lifting the curtain vertically;

a cinching belt proximal to the upper edge of the curtain for cinching the upper edge of the curtain either around a drill pipe if present, or to close the upper edge of the curtain, the cinching belt released by a first latch to cinch the upper edge of the curtain after the upper edge of the curtain is lifted above the blowout preventer;

a second latch responding to completing cinching the curtain, the second latch releasing the cables; and a fitting through the curtain, the fitting connectable to a hose reaching to the surface to carry oil captured by the curtain to a container residing on an ocean surface.

* * * * *